US005553351A

United States Patent [19]

Starks

[11] Patent Number: 5,553,351

[45] Date of Patent: Sep. 10, 1996

[54] HINGE-LOCK SECURITY SYSTEM

[76] Inventor: William R. Starks, 6814 Lakeshore Dr., Dallas, Tex. 75214

[21] Appl. No.: 387,570

[22] Filed: Feb. 13, 1995

[51] Int. Cl.[6] ..... E05D 11/10

[52] U.S. Cl. ..... 16/223; 16/343; 16/349; 16/388; 70/105; 70/136; 70/137; 292/210

[58] Field of Search ..... 16/223, 388, 82, 16/347, 349, 343, 319; 70/105, 136, 137; 292/210, DIG. 17

[56] References Cited

U.S. PATENT DOCUMENTS

| | | | |
|---|---|---|---|
| 1,248,854 | 12/1917 | Henderson | 16/388 |
| 1,411,220 | 3/1922 | Meyers | 70/105 |
| 1,428,915 | 9/1922 | Seweryn | 70/105 |
| 1,452,406 | 4/1923 | Arm | 70/136 |
| 1,456,886 | 5/1923 | Gober | 16/343 |
| 1,510,561 | 10/1924 | Segal | 70/105 |
| 2,577,456 | 12/1951 | Doman | 16/388 |
| 3,636,659 | 1/1972 | Bylicki . | |
| 3,805,325 | 4/1974 | Lee | 16/223 |
| 3,811,150 | 5/1974 | Chalmers . | |
| 3,970,340 | 7/1976 | Taft . | |
| 4,135,273 | 1/1979 | Holmes | 16/388 |
| 4,564,974 | 1/1986 | McGrail et al. . | |
| 4,648,252 | 3/1987 | Dugan | 70/137 |

*Primary Examiner*—M. Rachuba
*Assistant Examiner*—Donald M. Gurley
*Attorney, Agent, or Firm*—Randall C. Brown; James F. Struthers; Harrell Locke Purnell Rain

[57] ABSTRACT

A hinge-lock security system for preventing relative motion between a door and a door frame.

15 Claims, 3 Drawing Sheets

HINGE-LOCK SECURITY SYSTEM

BACKGROUND OF THE INVENTION

1. Field of the Invention

The present invention relates to a hinge-lock security system. The hinge-lock security system finds particular utility in providing supplemental protection against unwanted entry or exit through doors.

2. Description of Related Information

Rising fear and frustration associated with epidemic crime, including gang, juvenile and drug-related crime, have become an all-too familiar staple of modern life. And an ever-increasing public awareness of the high incidence of property theft and violent crime committed in homes and businesses has contributed to an unanswered need for sensible, economical devices to improve safety and security.

In the past, property owners and tenants wishing to secure their premises from unwanted access through hinged doors typically relied on deadbolts or door-handle devices to secure the door edge opposite the hinges. The hinge side of the door was held in place by the hinge, the hinge pin, and the hinge's supporting screws.

With a deadbolt system, an engaged deadbolt is disposed inside and in between the door and the door frame, thereby resisting intrusive forces directed against the outside of the door. However, if the deadbolt is disengaged, malfunctioning, or otherwise compromised, the hinge will rotate freely allowing the door to open. Even if the deadbolt is properly engaged, an intruder who has entered through a window may typically open a door from the inside without disturbing the deadbolt by removing the hinge pins and urging the door out of its frame.

A hinge lock adds to the integrity of a conventional door-security system by preventing rotation of the door about its hinges in the event the primary deadbolt is challenged or compromised.

Ideally, a hinge lock is compatible with hinges whose leaves are concealed when the door is shut since these unexposed hinge configurations are often desirable for aesthetic purposes. Many hinge locks employed in the past were incompatible with unexposed hinges. In addition, hinge locks employed in the past suffered from low resistance to intrusive force, were difficult to install or operate, and were cumbersome, complicated, expensive or unattractive.

A need exists, therefore, for an attractive, simple, high-strength hinge-lock security system that operates with unexposed hinges and that is easy to install. A need also exists for a system that prevents an intruder from opening a locked door by removing the door's hinge pins. The preferred embodiments of the present invention provide these advantages.

SUMMARY OF THE INVENTION

The apparatus of the present invention overcomes the above-mentioned disadvantages and drawbacks which are characteristic of the related information. The apparatus of the present invention allows door hinges to be locked to prevent rotation or unlocked to allow rotation, in a simple and effective way, and without compromising the attractiveness of the door and its frame.

A preferred embodiment of the present invention includes a door hinge having two leaves, a U-shaped latch that extends from the first leaf through a complementary slot in the second leaf when the hinge is closed, and a locking device, disposed within and adjacent to a chamber in the door or the door frame, that can be actuated to engage with or disengage from the latch.

The hinge leaves have alternating cylindrical knuckles on their edges with a bore extending through each knuckle such that when the bores are aligned, a pin may be disposed within the bores to secure the leaves to each other while allowing lateral rotation of the door about the axis of the aligned bores. Those of ordinary skill in the art will recognize that the extension of the latch into the door frame prevents removal of a locked door, even if the hinge pin is removed.

In a preferred embodiment, the first leaf is attached to the door frame (the "frame leaf") and the second leaf is attached to the inside edge of the door (the "door leaf"), such that the latch extends from the frame leaf through the complementary slot in the door leaf, and into a locking device located in a chamber in the door. Preferably, the door leaf and the frame leaf are countersunk so as to be flush with the edge of the door and the edge of the door frame respectively.

In a preferred embodiment, the locking device comprises a cam contained and rotatably supported within a support shell, and a device for turning the cam. The cam has a cusp that is adapted to engage with or disengage from the latch when the cam is rotated. The leading edge of the cusp is relatively sharp to facilitate initially hooking the latch. The cross section of the cusp then increases, such that the more the cam is rotated "into" the latch, the more it pulls on the latch.

In another preferred embodiment, one or more gears are also contained and rotatably mounted within the support shell and are operatively linked with the cam. In this embodiment, one gear functions as a drive gear and is engaged with the device for rotating the cam to transmit rotation through any intervening gears to the cam.

In a preferred embodiment, the support shell is cylindrical, is cantilevered off the door leaf, and extends into a cylindrical chamber which can be formed using conventional door-lock installation tools. In an alternate preferred embodiment, the shell has a rectangular cross section.

In a preferred embodiment, the cam and the intermediate gears, if any, include axial support arms that are rotatably anchored in bushings disposed inside the shell. The drive gear also comprises axial support arms, one of which also functions as a drive shaft. The drive shaft is cylindrical, protrudes through an aperture in the shell, and includes an axial cavity adapted to engage turning means such as a knob or key-operated drive. A suitable sleeve disposed in the shell aperture may be employed to facilitate rotation of the drive shaft therein.

Those of ordinary skill in the art will recognize that a variety of conventional gear and drive mechanisms may be employed to turn the cam, and that a variety of conventional support means may be employed. Those of ordinary skill in the art will also recognize that the cam or drive gear may be rotated using a variety of conventional turning devices including a keyless knob, a removable chuck, a key-operated drive outside the door, or a double-sided key system operable from both inside and outside the door.

In an alternate preferred embodiment the positions of the U-latch and slot are switched such that the U-latch extends from the door leaf through a slot in the frame leaf, and such that the U-latch and locking means extend into a chamber in the door frame rather than in the door. In other respects this alternate preferred embodiment is structured and operated as described above.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings.

DESCRIPTION OF THE PREFERRED EMBODIMENTS

Figure 1:
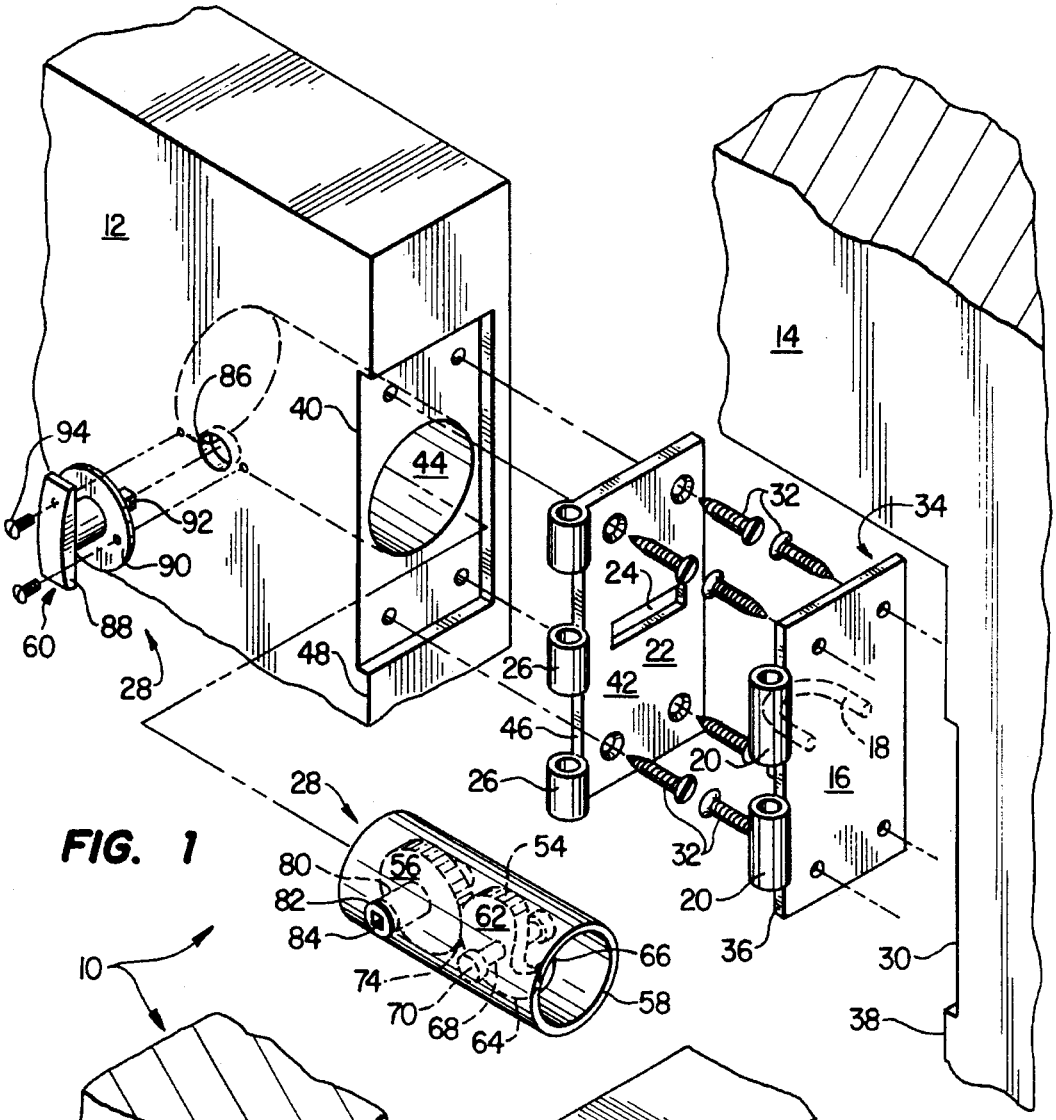
FIG. 1 is an exploded view of a preferred embodiment of the hinge-lock security system of the present invention.
Figure 2:
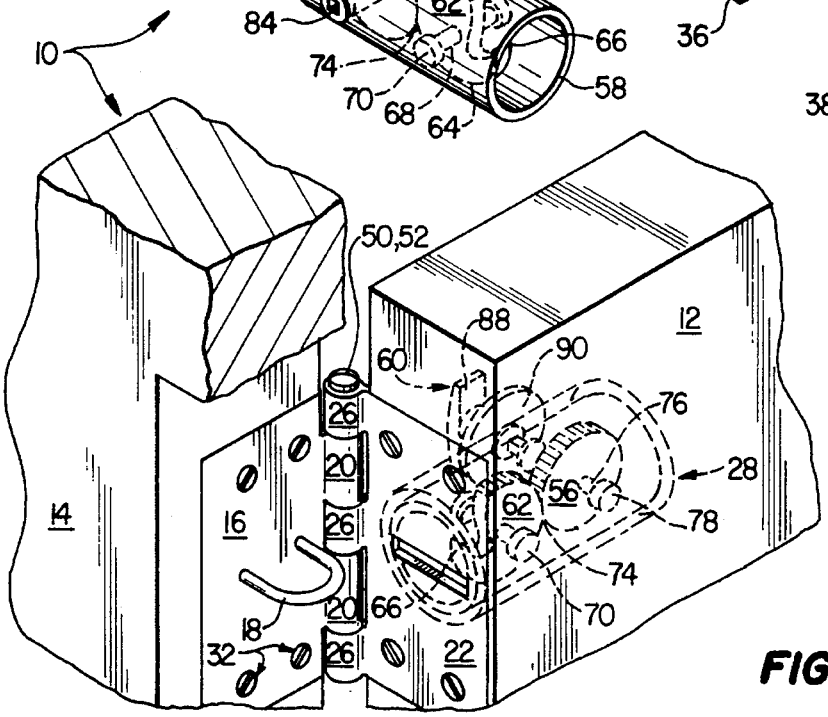
FIG. 2 is a perspective view of a preferred embodiment of the hinge-lock security system of the present invention with the door in an open position.
Figure 3:
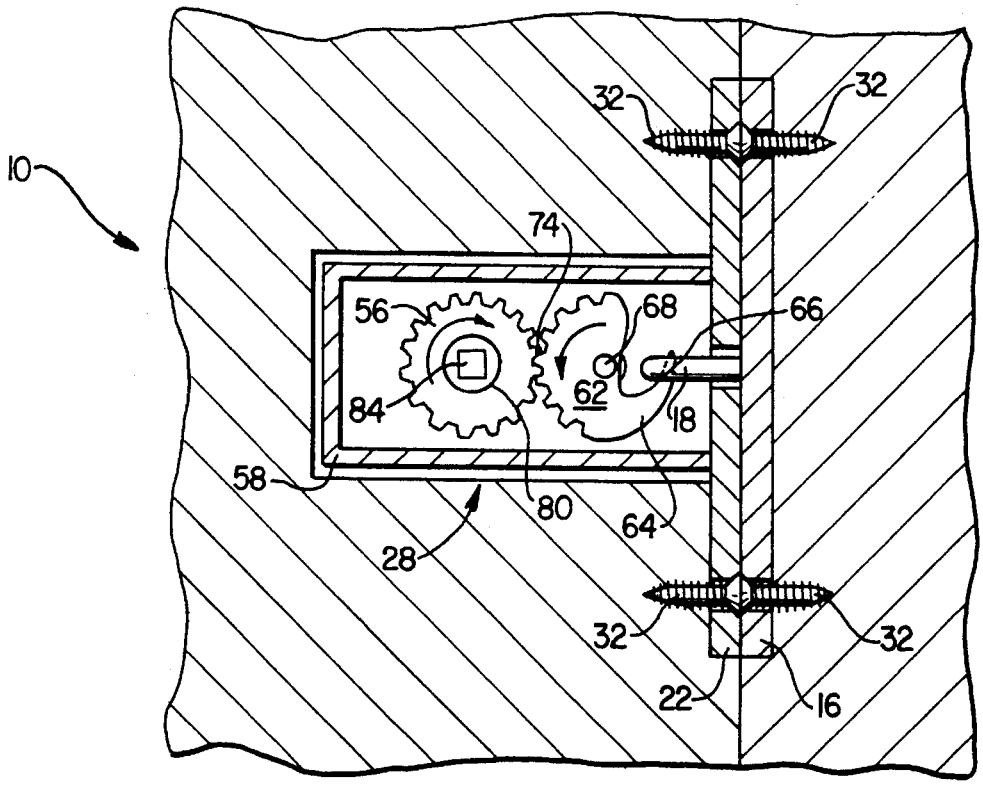
FIG. 3 is a cross-sectional view of a preferred embodiment of the hinge-lock security system of the present invention with the door in a closed position.

Referring now to the drawings, and particularly to FIGS. 1–3, a preferred embodiment of the hinge-lock security system of the present invention is shown and generally designated by the reference numeral 10.

The hinge-lock security system 10 is disposed to operate in conjunction with a door 12 and a door frame 14. The hinge-lock security system 10 comprises a frame leaf 16, having a U-latch 18 and cylindrical knuckles 20, a door leaf 22, having a slot 24 and cylindrical knuckles 26, and a locking device 28.

In a preferred embodiment of the present invention, frame leaf 16 is disposed within complementary groove 30 in door frame 14 and is engaged therein by screws 32, such that the outer surface 34 of frame leaf 16 is flush with the door frame 14. The U-latch 18 is disposed on the outer surface 34 of frame leaf 16, and two knuckles 20, each comprising a hollow cylinder, are attached to an edge 36 of the frame leaf 16 such that they extend beyond the inner edge 38 of the door frame 14.

Those of ordinary skill in the art will recognize that the shape of the U-latch may vary, and that the size of the latch may vary to affect the strength of the lock or to accommodate alignment error. Those of ordinary skill in the art will further recognize that the number of knuckles 20 disposed on the frame leaf 16 may vary.

Door leaf 22 is disposed within complementary groove 40 in door 12 and is engaged therein by screws 32, such that the outer surface 42 of door leaf 22 is flush with door 12. A slot 24 is disposed in the door leaf 22 and positioned over a cylindrical chamber 44 within door 12. The slot 24 is adapted to receive the U-latch 18 within the chamber 44.

Three knuckles 26, each comprising a hollow cylinder, are attached to an edge 46 of the door leaf 22 such that they extend beyond the inner edge 48 of the door 12 and such that the knuckles 26 on the door leaf 22 alternate and are axially aligned with the knuckles 20 on the frame leaf 16. A pin 50 is deployed through the knuckles 20, 26 and held in place by a head 52. Those of ordinary skill in the art will recognize that the number of knuckles 26 disposed on the door leaf 22 may vary.

Figure 5:
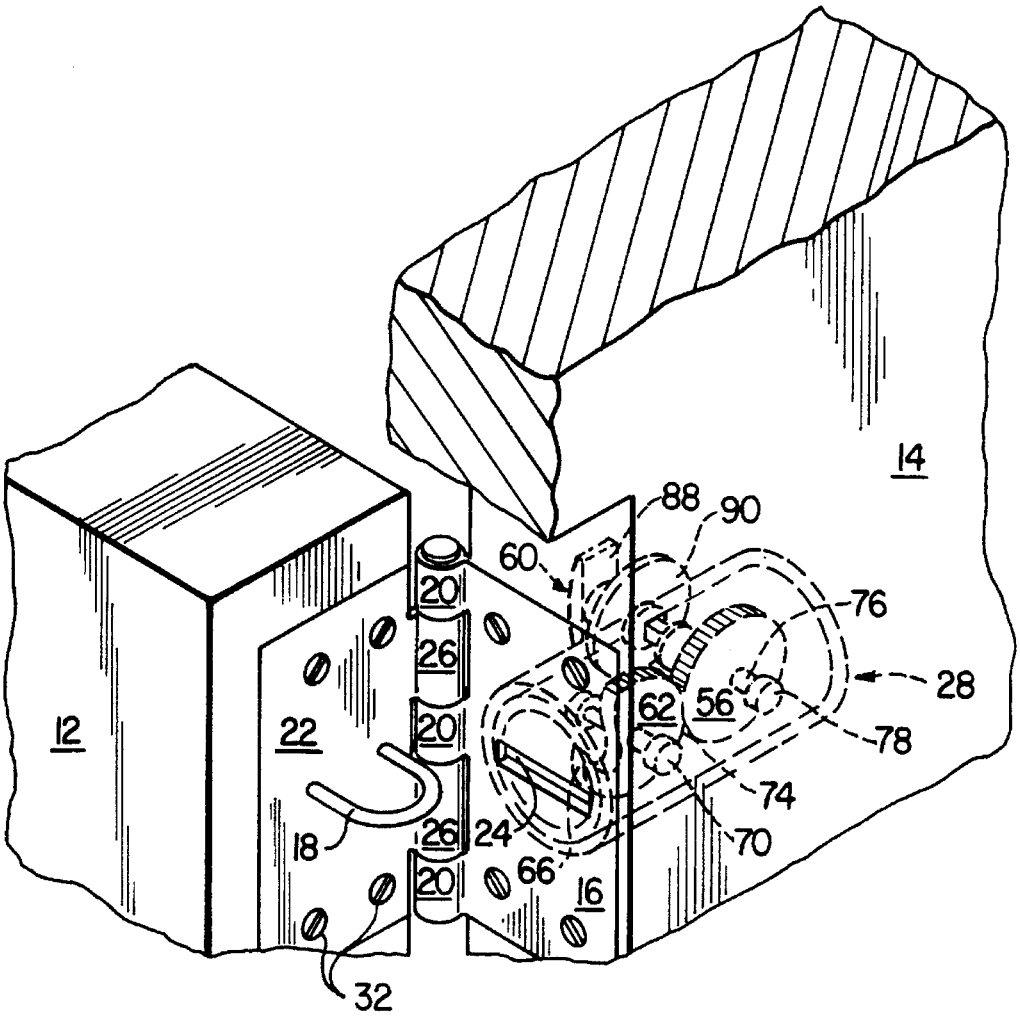
FIG. 5 is a perspective view of an alternate preferred embodiment of the hinge-lock security system of the present invention.

Persons of ordinary skill in the art will recognize that without changing the essential nature of the invention, the positions of the U-latch and slot may be switched such that the U-latch 18 and the locking device 28 extend into a chamber in the door frame 14 rather than the door 12 (as shown in FIG. 5).

In a preferred embodiment of the present invention, the locking device 28 includes a cam 54, a drive gear 56, and a cylindrical support shell 58, all disposed within the chamber 44. The locking device 28 also includes a turning apparatus 60 disposed adjacent to the shell 58.

The cam 54 is axially perpendicular to and rotatably mounted within the shell 58 and comprises a solid portion 62 and a cusp 64, wherein the cusp 64 is adapted to engage with or disengage from the U-latch 18 when the cam 54 is rotated. The cross-section of the cusp 64 decreases as a function of distance from the solid portion 62 and terminates in a point 66. The cam 54 is supported within the shell 58 by axial support arms 68 which are rotatably disposed within bushings 70 on the inside of the shell 58.

In a preferred embodiment, the drive gear 56 is axially perpendicular to and rotatably mounted within the support shell 58, and interengaged with the cam 54 by a plurality of teeth 74. The drive gear 56 is supported on one side by an axial support arm 76 rotatably disposed within a bushing 78 on the inside of the shell 58.

The other side of the drive gear 56 is supported by a drive shaft 80 comprising a cylindrical arm that extends axially from the drive gear 56 and protrudes through an access aperture 82 in the shell 58. The drive shaft 80 has a cavity 84 having a rectangular cross-section adapted to be engaged by the turning apparatus 60. When the hinge-lock security system 10 is installed, the drive shaft 80 and cavity 84 are aligned with the access hole 86 in door 12.

Those of ordinary skill in the art will recognize that any number of gears and many types of gears may be deployed between the drive gear and the cam while still allowing transmission of the rotation of the turning apparatus to the cam. Those of ordinary skill in the art will also recognize that a drive shaft may be substituted for a cam support arm 68 such that the turning apparatus 60 may be directly engaged with the cam 54, such that a drive gear 76 is unnecessary.

In a preferred embodiment of the present invention, the turning apparatus 60 comprises a knob 88 rotatably mounted on a faceplate 90, wherein the knob 88 comprises a projection 92 of rectangular cross section adapted to extend through the access hole 86 and to be received within the drive shaft cavity 84 such that rotation of the knob 88 is transmitted through the drive shaft 80 and the drive gear 56 to the cam 54. The faceplate 90 is attached to the door 12 using two screws 94.

Those of ordinary skill in the art will recognize that the cross-section of the drive-shaft cavity 84 and knob projection 92 need not be rectangular. And those of ordinary skill in the art will recognize that the knob 88 may be replaced by a removable chuck key or a key-operated device. Those of ordinary skill in the art will further recognize that the turning apparatus may be disposed inside or outside the door 12. The turning apparatus may also be located both inside and outside the door 12, as with a double-keyed lock, to prevent opening of the hinge lock from the inside or outside without a key.

In operation of the hinge-lock security system 10, a user first shuts the door 12 so that the U-latch 18 on the frame leaf 16 is disposed through the slot 24 in the door leaf 22 and within the support shell 58 which is within the chamber 44. The user then rotates the knob 88, which rotates the drive shaft 80, which rotates the drive gear 56, and which rotates the cam 54 such that the cusp 64 rotates into and engages the U-latch 18. To disengage the cusp 64 from the U-latch 18, the user rotates the knob 88 in the opposite direction.

Figure 4:
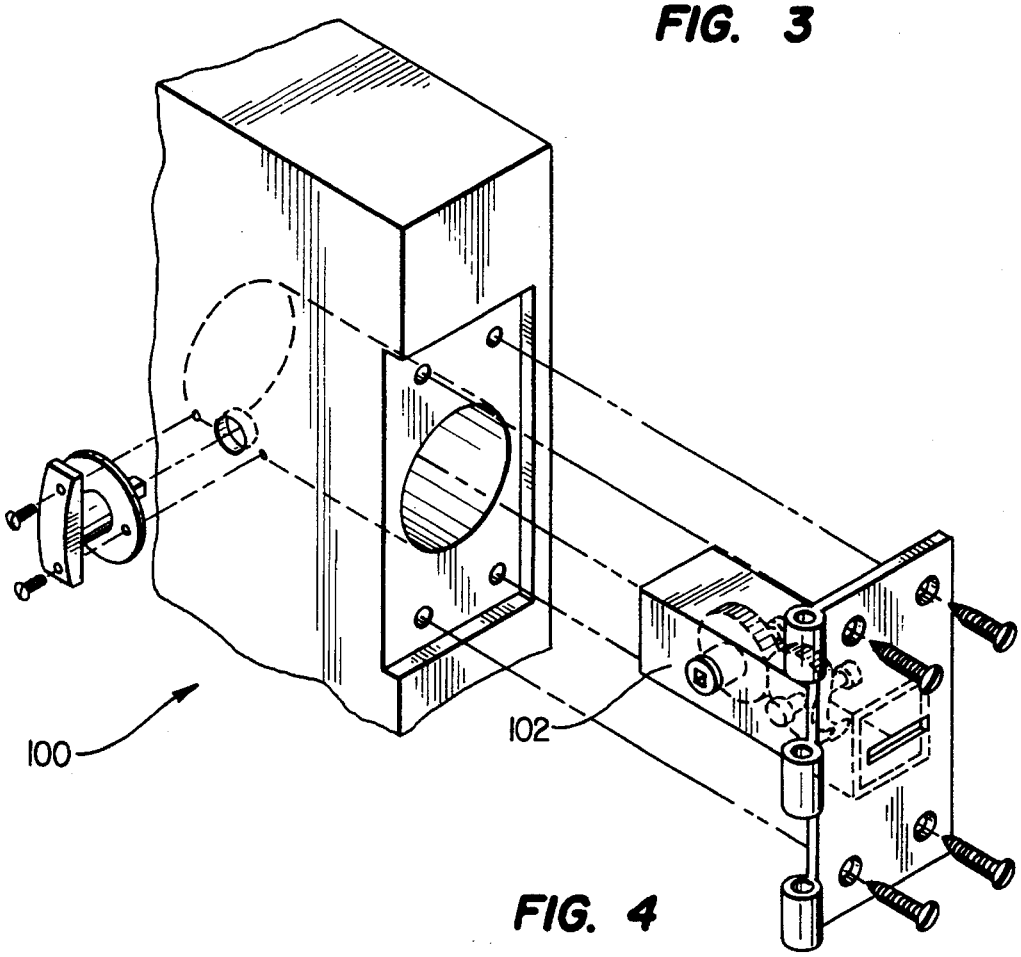
FIG. 4 is an exploded view of an alternate preferred embodiment of the hinge-lock security system of the present invention.

Referring to FIG. 4, an alternate preferred embodiment of the hinge-lock security system of the present invention is generally designated by the reference numeral 100. In the alternate embodiment 100, the support shell 102 has a rectangular cross section. In all other respects, the alternate embodiment 100 is structured and operable as is described above.

While preferred embodiments of the invention have been shown and described, it will be understood by persons skilled in the art that various changes and modifications may be made without departing from the spirit and scope of the invention which is defined by the following claims.

What is claimed is:

1. Apparatus for preventing relative motion between a door and a door frame, comprising:

a) a door having a chamber therein;

b) a door frame;

c) a hinge for attachment to and providing relative motion between said door and said door frame, said hinge comprising a first leaf for attachment to said door frame and a second leaf for attachment to said door, said first leaf comprising a latch and said second leaf comprising a slot for receiving said latch within said chamber, said first leaf and said second leaf each comprising at least one cylindrical knuckle having a bore extending therethrough, said cylindrical knuckles of said first leaf and said second leaf being axially aligned to define a cylindrical aperture extending therethrough, wherein a pin for preventing disengagement of said first leaf and said second leaf extends within said cylindrical aperture;

d) locking means for preventing relative motion between said door and said door frame, said locking means being disposed within said door chamber adjacent said hinge, and being alternately movable between a first unlocked position, whereby relative motion between said door and said door frame is permitted, and a second locked position, wherein said locking means engages said latch and prevents relative motion between said door and said door frame.

2. The apparatus of claim 1 wherein said latch is U-shaped.

3. The apparatus of claim 1 wherein said chamber is cylindrical.

4. The apparatus of claim 1 wherein said locking means comprises:

a) a shell fixedly attached to said second leaf and extending from said slot, said shell having an access aperture;

b) a cam rotatably mounted within said shell and having a solid portion and a cusped portion extending from said solid portion for engaging with and disengaging from said latch; and c) turning means for rotating said cam, said turning means being engaged with said cam through said aperture.

5. The apparatus of claim 4 wherein said shell is cylindrical.

6. The apparatus of claim 4 wherein said shell has a rectangular cross section.

7. The apparatus of claim 4 wherein said cusped portion of said cam has a cross section that decreases as a function of increasing distance from said solid portion of said cam.

8. The apparatus of claim 4:

wherein said cam further comprises a drive shaft fixedly attached to said cam and extending toward said access aperture, said drive shaft having a cavity; and wherein said turning means further comprises a projection adapted to be received within said cavity.

9. The apparatus of claim 8 wherein said cavity and said projection are of rectangular cross section.

10. The apparatus of claim 8 wherein said turning means further comprises a first key-operated device disposed on the outside surface of said door.

11. The apparatus of claim 8 wherein said locking means further comprises a second key-operated device adapted to actuate said cam, said second key means being disposed on the inside surface of said door.

12. The apparatus of claim 1 wherein said locking means comprises:

a) a shell fixedly attached to said second leaf and extending from said slot, said shell having an access aperture;

b) a cam rotatably mounted within said shell and having a cusped portion for engaging with and disengaging from said latch;

c) a drive gear rotatably mounted within said shell and operatively engaging said cam; and d) turning means for rotating said drive gear, said turning means being engaged with said drive gear through said aperture.

13. The apparatus of claim 12:

wherein said drive gear further comprises a drive shaft fixedly attached to said drive gear and extending toward said access aperture, said drive shaft having a cavity; and wherein said turning means further comprises a projection adapted to be received within said cavity.

14. The apparatus of claim 1 wherein said locking means comprises:

a) a shell fixedly attached to said second leaf and extending from said slot, said shell having an access aperture;

b) a cam rotatably mounted within said shell, said cam having a cusped portion for engaging with and disengaging from said latch;

c) an intermediate gear array rotatably mounted within said shell and operatively engaging said cam;

d) a drive gear rotatably mounted within said shell and operatively engaging said intermediate gear array; and e) turning means for rotating said drive gear, said turning means being engaged with said drive gear through said aperture.

15. Apparatus for preventing relative motion between a door and a door frame, comprising:

a) a door;

b) a door frame having a chamber therein;

c) a hinge for attachment to and providing relative motion between said door and said door frame, said hinge comprising a first leaf for attachment to said door and a second leaf for attachment to said door frame, said first leaf comprising a latch and said second leaf comprising a slot for receiving said latch within said chamber, said first leaf and said second leaf each comprising at least one cylindrical knuckle having a bore extending therethrough, said cylindrical knuckles of said first leaf and said second leaf being axially aligned to define a cylindrical aperture extending therethrough, wherein a pin for preventing disengagement of said first leaf and said second leaf extends within said cylindrical aperture;

d) locking means for preventing relative motion between said door and said door frame, said locking means being disposed within said door frame chamber adjacent said hinge, and being alternately movable between a first unlocked position, whereby relative motion between said door and said door frame is permitted, and a second locked position, wherein said locking means engages said latch and prevents relative motion between said door and said door frame.

* * * * *